US006099444A

United States Patent [19]

Domenge

[11] Patent Number: 6,099,444

[45] Date of Patent: Aug. 8, 2000

[54] INERTIAL EXERCISER

[76] Inventor: Alberto G. Domenge, Fuente de las Aguilas #194, Tecamachalco 53950 Edo de mex, Mexico

[21] Appl. No.: 09/120,889

[22] Filed: Jul. 23, 1998

[51] Int. Cl.[7] ..... A63B 21/22

[52] U.S. Cl. ..... 482/110

[58] Field of Search ..... 482/93, 106, 110; 446/266

[56] References Cited

U.S. PATENT DOCUMENTS

| | | | |
|---|---|---|---|
| 983,372 | 2/1911 | Johnson | 402/106 |
| 2,821,394 | 1/1958 | Barbeau . | |
| 3,403,906 | 10/1968 | Burzenski . | |
| 3,482,835 | 12/1969 | Dean . | |
| 3,708,164 | 1/1973 | Griffin . | |
| 3,796,431 | 3/1974 | Sinyard . | |
| 3,809,393 | 5/1974 | Jones . | |
| 4,043,553 | 8/1977 | Suarez . | |
| 4,150,580 | 4/1979 | Silkebakken et al. . | |
| 4,171,805 | 10/1979 | Abbott . | |
| 4,278,248 | 7/1981 | Kifferstein | 482/93 |
| 4,513,963 | 4/1985 | Nelson et al. . | |
| 4,632,391 | 12/1986 | Orak | 482/110 |
| 4,703,928 | 11/1987 | Escher . | |
| 4,714,246 | 12/1987 | Parisien . | |
| 4,775,147 | 10/1988 | Bold, Jr. . | |
| 4,900,017 | 2/1990 | Bold, Jr. . | |
| 5,046,727 | 9/1991 | Wilkinson et al. . | |
| 5,163,888 | 11/1992 | Stearns . | |
| 5,244,445 | 9/1993 | Amesquita . | |
| 5,304,108 | 4/1994 | Denega et al. . | |
| 5,643,162 | 7/1997 | Landers et al. . | |
| 5,707,325 | 1/1998 | Chiou . | |

FOREIGN PATENT DOCUMENTS

| | | | |
|---|---|---|---|
| 2043395 | 5/1972 | Germany | 482/93 |

*Primary Examiner*—John Mulcahy
*Attorney, Agent, or Firm*—Greenblum & Bernstein, P.L.C.

[57] ABSTRACT

An inertial exercise device includes an internal hollow casing containing one or more spherical shaped weights for rolling and/or sliding movement within the hollow casing. The weights have an initial force imparted to them by a user of the exercise device. Once set in motion, the mass of the weights provide an inertia to the exercise by requiring the user to maintain the movement or work against the movement of the weights. Different types of motion can be imparted to the weights so as to provide exercise of varying difficulty and to provide exercise to different muscle groups.

3 Claims, 15 Drawing Sheets

INERTIAL EXERCISER

BACKGROUND OF THE INVENTION

1. Field of the Invention

The present invention relates to exercise devices and, more particularly, to exercise devices which use the principle of inertia in order to enhance and intensify an exercise performed with such inertial exercise devices.

2. Discussion of Background Information

In recent years people have become more and more conscious of the need to exercise in order to maintain a healthy life-style. Many different types of exercise have become popular and some exercises are directed or devoted to improving various aspects of the body's fitness and performance. A comprehensive list of such types of exercises and exercise devices is, in today's society, overwhelming. Many people have become confused as to what exercise and what type of exercise device is suitable for their purposes. Thus, many types of exercise devices are of common knowledge to an informed consumer or physical fitness devotee. There are many examples of such exercise devices, including inertial-type exercise devices.

U.S. Pat. No. 3,796,431 discloses an exercising device in the form of a dumbbell. The device is provided with rotatable spherical weights, which allow the device to be rolled along a flat surface such as a floor or wall, in addition to lifting the device in the conventional manner.

U.S. Pat. No. 4,900,017 is a device similar to that described above, in which an inertial force exercise device includes a wheel member operable to engage and roll on a surface during an exercise routine. An axle member is required to extend in a predetermined manner so as to be controlled by an operator of the device. An inertial mass structure is connected to the axle for translation with the axle, without rotation with respect to the axle, for providing an inertial resistance through non-rotational translation so as to exercise a user's body. Due to the mass of the device a substantial linear inertia is produced.

U.S. Pat. No. 4,714,246 discloses an exercise device in the form of a disk provided with handles, and a resilient ball tethered to the center of the disk. By imparting a predetermined motion to the tethered ball, it can move in predetermined directions while bouncing periodically inside the disk. Various weights can be attached individually or a plurality of weights can be attached simultaneously.

U.S. Pat. No. 4,513,963 is directed to a body exercise device having a tubular member provided inside thereto with an axially disposed rotatable bar member, the external ends of which are provided with radial pieces or connectors parallel to each other. A weight is provided adjacent to the end of the connector not attached to the rod. The connector that rotates the weights is limited in radius and can possibly harm the user as the weights are free in the sense that they are not protected from causing injury to the user.

U.S. Pat. No. 4,043,553 discloses an exercising device with eccentric weights. Hand grips are provided to be rotatably secured to an eccentric weighted cross shaft The device includes two spaced ends and at least one generally cylindrical griping portion between the ends. The frame may be rotated within the hand grip and an eccentric weighted means for the frame is located adjacent each spaced end. The weighted means comprises an intermediate coupling element having a first coupling means for fixedly and non-rotatably coupling the element to the frame at one of the spaced ends.

U.S. Pat. No. 4,140,580 discloses a hand-held ball shaped case having a shaft mounted inertial wheel or rotor provided with fins. The casing leaves exposed part of the rotor, so that an initial spin can be imparted to it and afterwards, the rotor spins so that it is maintained by imparting a periodic motion thereto. The device is basically a gyroscope with a race designed for providing smooth rotor movement.

U.S. Pat. No. 3,809,393 discloses an exercise device having a handle supported by at least three swivel casters. The device can be moved about a floor. However, the device does not appear to truly be an inertial exercise device as it does not produce inertial resistance to movement imparted to the device by a user.

U.S. Pat. No. 4,775,147 is an inertial exercise device having three independent rotational inertial systems. A plurality of wheel and axle elements are required to cooperate with weight elements so that rolling of the devices produces an inertial force. The device appears to be for floor-type exercise and is directed to an open-type, non-protected weight element for providing the inertial force when receiving initial movement by a user.

U.S. Pat. No. 4,171,805 is directed to a rollable hand held exercise device that requires an additional, stationary element for providing a rolling surface. The device is not a true inertial-type exercise device as it requires a special surface to provided rolling contact surfaces which the user must use in conjunction with the weights so as to guide the weights in a manner designed to force certain muscle groups to work.

U.S. Pat. No. 5,046,727 is a wrist exercise device having a hollow shaft which houses a spring element. Tension disks are connected to the springs so that the disks can be moved toward and away from each other by turning a tension adjusting knob at ends of the device.

U.S. Pat. No. 5,643,162 discloses an exercise apparatus which is used in a forward and/or lateral movement in an extension type of exercise. While rolling and/or sliding of the device is considered, inertial exercise is not truly disclosed. This is an example of a low-friction type exercise device that, on its surface, may appear to be an inertial exercise device. However, It is apparent that low-friction type exercise does not imply an inertial exercise element.

U.S. Pat. No. 5,707,325 discloses an exercise device relating to a roller type device. The exerciser includes a roller for rolling along a first direction from a first position. Intermediate positions are defined as the device proceeds from the first position to the final position. The route of the device is then repeated back to the start position. Energy storing means are provided to effect movement from one position to another. The storing devices are springs which are contracted and released as the device moves from one position to another.

U.S. Pat. No. 5,163,888 discloses a exercising apparatus in which different linkages are moved in response to movement of a user. The movements of the various links function to provide a resistance against which the user must work.

U.S. Pat. No. 5,304,108 discloses a resist and assist exercising device. The device allows the user to impart movement to the exercise device along a particular direction and the user may continue the application of force in that direction. Alternatively, the user may resist the force imparted to the first direction by trying to impart force in another direction. However, while the exerciser is of the assist/resist type, the device operates by use of an essentially weightless mass. Thus, it is not a true inertial type exercise device.

U.S. Pat. No. 3,403,906 discloses an exerciser with grippers mounted on a shaft This exerciser is again a roller type exercise device which does not require the user to work against an inertia imparted to the device by the user.

U.S. Pat. No. 3,708,164 discloses a manual torsion exerciser in which a torsional member is positioned within a tubular member and extends from the outer end part of one tubular member to the outer end part of another tubular member. A retainer member is releasible engaged with one end of the torsional member so that the torsional member will be placed under torsional stress upon rotation of one tubular member relative to the other tubular member.

U.S. Pat. No. 2,821,394 discloses a spring-roller type exercise device in which the device is designed to be rolled on a floor so as to cause the user to impart force to a coil-type spring. Movement back and forth of the exerciser along the floor coils and uncoils the spring, forcing the user to work against the spring force in a coiling and uncoiling mode.

U.S. Pat. No. 4,703,928 discloses a precessional exercise device designed only for foot exercises. A spinning mass forms the rotor of a motor for spinning the mass. Rotational movement of the foot is opposed by a gyroscopic effect produced by the spinning mass. This produces an isometric exercise effect when the foot is rotated while the torque of the spinning mass is opposed by other muscles of the foot.

U.S. Pat. No. 5,244,445 discloses an exercise wand. The wand has a hollow rigid tube having a length sufficient to extend a substantial distance to either side of the body median plane. A plurality of spheres are enclosed in the hollow wand. Movement in one direction causes the spheres to roll in the wand from end to end and add momentum to the movement so as to provide an extra push to the movement of the body.

U.S. Pat. No. 3,482,835 discloses a barbell with an eccentric weight Movement of the barbell causes a force to be imparted to the weight so that it rotates eccentrically about the shaft of the barbell. The device uses the effects of centrifugal force to require the user to coordinate his/her movement of the barbell with the movement of the eccentric weight.

The foregoing devices are of different types and are designed to produce different results. Each type of exercise device has its own advantages and disadvantages. However, all of the known exercising devices have at least one common disadvantage. That is, they do not utilize the effects of inertia to permit a user to first impart movement to an exercise device and then work against the movement in a variety of ways so as to provide a complete workout for a user or team of users. The foregoing devices require the use of, among others, tension springs, compression springs, eccentrically mounted weights, offset shafts, etc. All of which unnecessarily complicate such exercising devices and necessarily lead to an increased cost of manufacture and a consequent increased cost to the consumer.

SUMMARY OF THE INVENTION

The invention of the present application was developed to overcome the problems of the known exercising devices. More particularly, the invention was developed to provide an inertial exercise device that is effective in promoting healthy exercise with a minimum of stress to the muscle groups so a to thereby avoid injuries often associated with exercise. In addition, the inertial exercise device of the present invention relies on a simple, though ingenious, design for coaxing a maximum workout from a user while at the same time permitting the user to enjoy the workout.

To this end, the invention of the present application was developed to provide an inertial exercise device having a first housing member, a second housing member connected to the first housing member so as to define a recess between the first housing member and the second housing member. At least one substantially spherically weight member is located in the recess in a manner so as to be movable therein. A holding element is connected to at least on of the first housing member and the second housing member so that a user of the exercise device can impart and control movement of the exercise device. Movement of the exercise device imparts a moment of inertia to the weight member so as to require increased resistance by the user as the inertia of the weight member is increased.

Another aspect of the present invention is to provide a first arcuate inner member section connected to an exterior wall of the first housing member. A second arcuate inner section is connected to an exterior wall of the second housing member. A first flat ring is secured to the first arcuate inner section and a second flat ring is secured to the second arcuate inner section. A securing element connects the first flat ring and the second flat ring so that the first housing member and the second housing member, the first arcuate inner section, the second arcuate inner section, the first flat ring and the second flat ring are maintained in a fixed positional relationship.

Another object of the present invention is to provide an inertial exercise device having a connecting part extending from the first flat ring and the second flat ring so that the holding element is connected to the first flat ring and the second flat ring. An adjusting member is connected to the holding element to permit adjustment of the holding element in accordance with a size of the user of the exercise device.

A further object of the invention is to provide an inertial exercise device wherein the holding element is a handle member fixedly secured to one of the first housing member and the second housing member.

Another object of the invention is an inertial exercise device having a third housing member, a fourth housing member connected to the third housing member so as to define a recess between the third housing member and the fourth housing member. At least one substantially spherical weight is located in the recess in a manner so as to be movable therein and a bar element is fixedly secured to one of the first housing member and the second housing member and also one of the third housing member and the fourth housing member.

Still another object of the invention is to provide an inertial exercise device having a third housing member and in which the first housing member is substantially a right circular cylinder. The second housing member encloses a first end of the first housing member and the third housing member encloses an opposite end of the first housing member.

A further object of the invention is an inertial exercise device having a spring member positioned in the first end and the opposite end of the first housing member, the weight member being positioned in the recess defined by the right circular cylinder and the spring member so as to be movable therein.

Another object of the invention is to provide an inertial exercise device which includes two such devices connected together with the second exercising device having housing members like the first exercise device and having a connecting member connecting the two exercise devices.

Another object of the invention is an inertial exercise device having spring members positioned in ends of the housing member with the weight member positioned in the recess defined by the right circular cylinder and the spring members so as to be movable therein. a fastening member is connected to the connecting member so as to fasten a first end and a second end of the connecting member in an adjustable manner. The connecting member is attached to a body part of the user to impart one of a linear and a circular motion to the inertial exercise devices when the user imparts a force to the devices.

Another object of the invention is to provide the inertial exercise device with semi-spherical shaped housing members.

Another object of the invention resides in the housing members being connected to the bar element so that the housing members are substantially flat on a side which connects to the bar element. The flat housing sides being substantially perpendicular.

A further object of the invention is to provide a plurality of weights in each of the recesses of the exercise device.

Still another object of the invention is to provide an inertial exercise device having a ring-shaped housing member and a substantially circular housing member with an open portion concentric with the ring housing member. A pair of circular side walls extend from a base portion of the circular housing member so as to define a recess therebetween.

Another object of the invention is to provide the inertial exercise device with securing elements fixedly connecting the ring-shaped member to the circular member so as to enclose the recess and to have at least one substantially spherical weight member located in the recess so as to be movable therein.

Another object of the invention is to provide a pair of handles extending from one of the ring members and the circular housing so as to allow a user to grasp and control movement of the device.

Another object of the invention is the provision of upper and lower surfaces of the ring member which are substantially flat and parallel. The circular housing member has a bottom wall surface and an open portion wall surface each of which is substantially flat and parallel with each other and the ring shaped member.

Another object is to provide a pair or circular side walls substantially parallel and spaced from each other by a distance that is approximately equal to a width of the ring member.

Another object is the provision of a pair of circular side walls that are substantially parallel and spaced from each other by a distance that is approximately equal to a width of the ring member.

Another object of the invention is to provide an inertial exercise device having a plurality of substantially spherical weights located in the recesses.

Still a further object of the invention is the inclusion of swivel casters fixedly secured to the base portion of the circular housing member.

Another object of the invention is to provide the swivel caster in an eccentric mounting position with respect to a location of being fixedly secured to the base portion.

Another object of the invention is to provide an inertial exercise device having a control panel extending from an exterior side wall of the circular housing member and receptacles provided on the control panel for receiving both feet of a user of the device. The user imparting movement to the device through use of leg muscles of the user.

Another object of the invention is to provide an inertial exercise device with a substantially arcuate member having substantially flat, parallel top and bottom sidewalls and a substantially straight segment integrally connected to the first and the second arcuate members and having a base portion and vertically extending side walls. A second substantially straight segment is integrally connected to the first and second arcuate members and has a substantially flat parallel top and bottom wall element. A recess is formed by the bottom wall and the vertically extending sidewall portions. The second arcuate member and the interconnecting segment being fixedly secured to the vertically extending sidewall so as to enclose the recess. A substantially spherical weight member is located in the recess.

Still another object of the invention is to provide an inertial exercise device with a set of handles connected to an arcuate member and another set of handles connected to another arcuate member. At least one user of the device can grasp one of the first and second set of handles while the exercise device is adjacent the abdomen or other body part of the user so as to impart motion to the weight so as to move the weight along a predetermined pathway.

BRIEF DESCRIPTION OF THE DRAWINGS

The present invention is further described in the detailed description which follows, with reference to the plurality of drawings by way of non-limiting examples of preferred embodiments of the present invention. In the drawings, like reference numerals represent similar parts throughout the several views of the drawings, and wherein.

DETAILED DESCRIPTION OF THE INVENTION

The particulars show herein are by way of example and for purposes of illustrative discussion of the embodiments of the present invention only and are presented in the cause of providing what is believed to be the most useful and readily understood description of the principles and conceptual aspects of the present invention in more detail than is necessary for the fundamental understanding of the present invention, the description taken with the drawings making apparent to those skilled in the art how the several forms of the present invention may be embodied in practice.

The inertial exercise device of the present invention is useable in many different ways, such as hand-held in any position as in the palm of a user's hand in order to develop hand, wrist and arm muscles. The device can be held in front of the body, over the head, in the region of the hips and/or abdomen so as to effect the various muscle groups of the body. The inertial exercise device may be used alone or by pairs or groups of users. The inertial exercise device provides for continual change of direction of a spherical weight so as to increase the mass momentum and the resistance that must be overcome to control the device. In this respect, the inertial exercise device provides a resistance that a user of the device must overcome and control during the exercise. This movement is not unidirectional as is the case with gravity and spring-based exercise devices.

In an inertial exercise device, as the speed of the exercise is increased, the moment of inertia of the weights is increased and so is the resistance that the gymnast or user must overcome. Using an inertial exercise device can prolong the time of the exercise since the weights, once set in motion, require relatively little energy to keep them moving. The inertial principles on which the exerciser is based makes it ideal for aerobic exercises that tend to promote general fitness and to improve cardiovascular conditioning.

Figure 1:
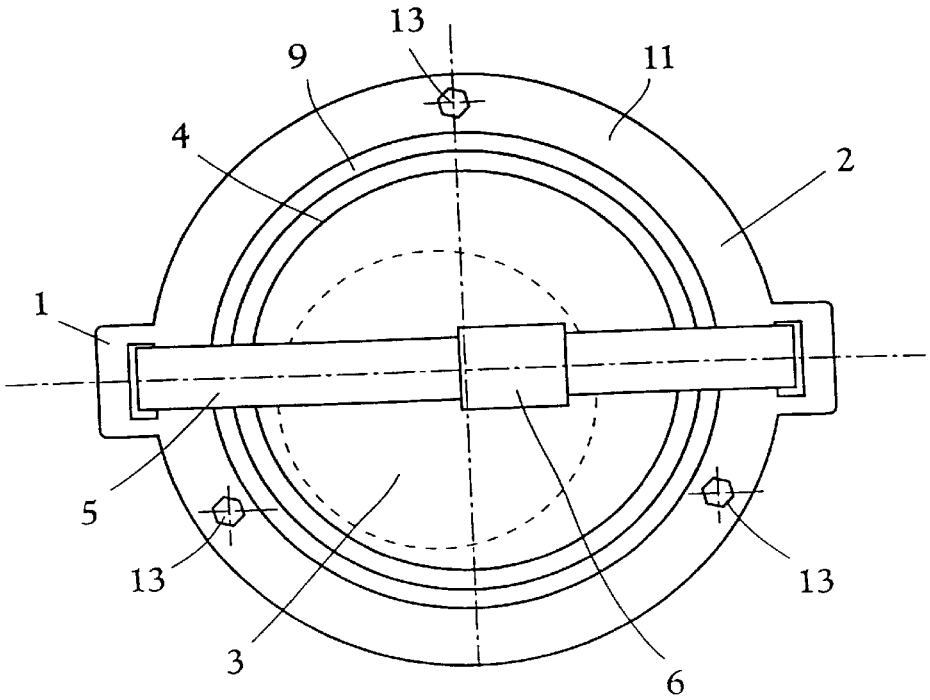
FIG. 1. represents a top cross-sectional view of a spherical hand-held exerciser, provided with an external spherical hollow casing and a smaller internal spherical shaped weight, capable of rotating within the walls of the spherical casing. and provided with a hand strap.

FIG. 1 is a side cross-sectional view of the inertial exercise device. Therein, a handheld device 1 is shown in which an external hollow substantially spherical casing 2 contains a smaller diameter solid spherical shaped weight 3 which can roll or slide by inertia on the inner surface 4 of the hollow spherical casing 2. The casing 2 is provided with an external strap 5 that permits attachment of the exercise device to a hand of the user. The strap 5 is provided with a buckle 6 so as to permit adjustment of the strap 5 and permit comfort and adjustment of the exerciser to the hand of the user. Two semi-spherical elements 7 and 8 form the external casing 2. The semi-spheres 7 and 8 are provided with securing elements that secure the two semi-spheres 7 and 8, one to the other. The securing elements are in the form of external rings having arcuate inner sections 9 and 10. The arcuate inner sections are of a size corresponding to fit the outer surfaces of the semi-spheres 7 and 8. Flat rings 11 and 12 are rigidly secured to the rings 8 and 9 and tightly secured to each other by screws or and other suitable securing element 13.

When a substantially elliptical movement is imparted to the exerciser 1, by movement of the hand of the user, the spherical shaped weight or weights 3 roll or slide on the inner surface 4 of the casing 3. Movement of the spherical shaped weight or weights 3 causes the weight to be displaced in a circular movement in a given plane of rotation. The plane of rotation being determined by the position of the device and its orientation by the user of the device.

Figure 2:
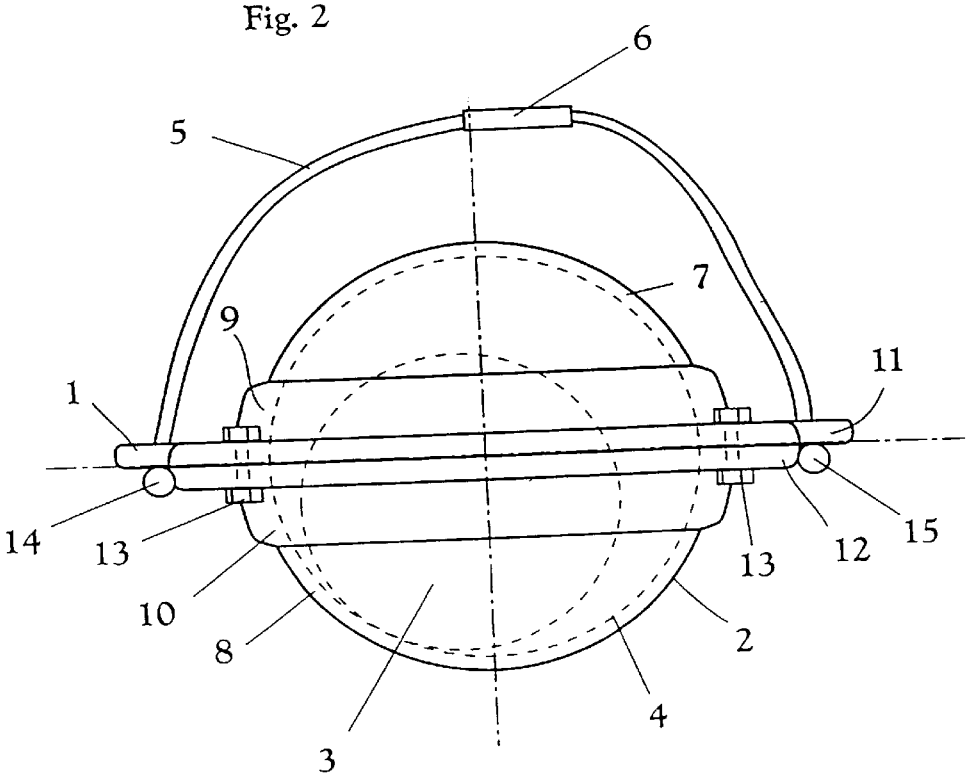
FIG. 2 is a lateral cross-sectional view of the hand-held exerciser of FIG. 1.

FIG. 2 of the exerciser 1 shows that the hollow spherical casing is formed by a top hollow semi-sphere 7 and a bottom hollow semi-sphere 8. The rings 9 and 10 are rigidly attached to the flat rings 11 and 12 which, in turn, are tightly secured to each other by screws or appropriate securing elements 13. The strap 5 and adjustment buckle 6 is attached to the top flat ring 11 at an outermost diametrical position of the ring 11. The points of attachment are shown at 14 and 15.

Figure 3:
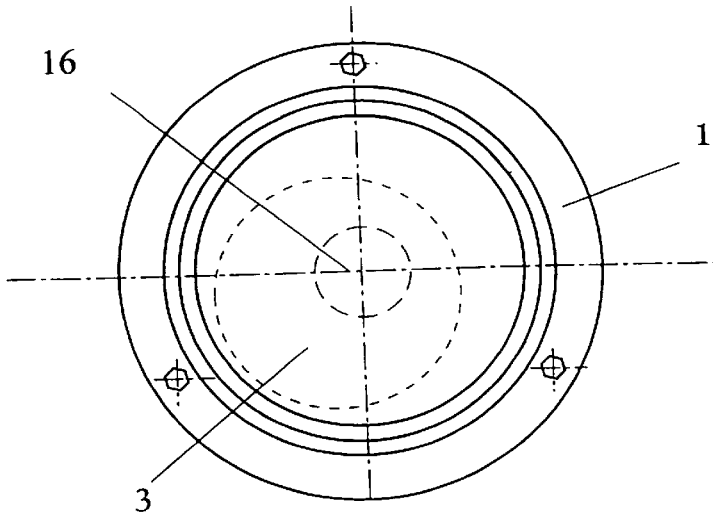
FIG. 3 is a top cross-sectional view of a spherical hand-held exerciser provided with a handle.
Figure 4:
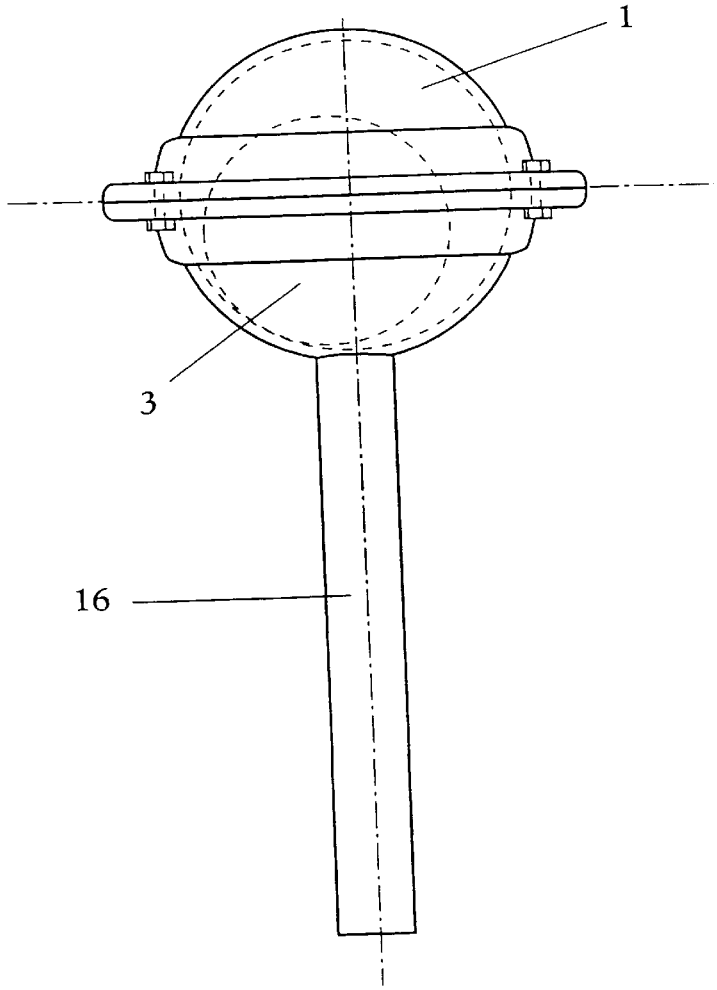
FIG. 4 is a longitudinal side view of the exerciser of FIG. 3.

FIGS. 3 and 4 show the exerciser device 1 provided with a handle member 16. The handle is attached to the spherical casing 2 at a bottom center area of the semi-sphere 8. In the alternative, the handle 16 can be attached to the semi-sphere 7. By providing a handle member instead of the strap 5, different types of movement, and consequent different types of exercise can be performed. It is apparent that grasping the handle 16, at different lengths along the handle would provide different types of exercise as the fulcrum point would shift, with respect to the hand of the user, so as to require more or less effort in holding and/or imparting movement to the exerciser 1. While the handle 16 is shown as being attached to the semi-sphere 8 at a bottom central region thereof it is apparent that other regions of attachment to the semi-spheres 7 and 8 could also be provided.

Figure 6:
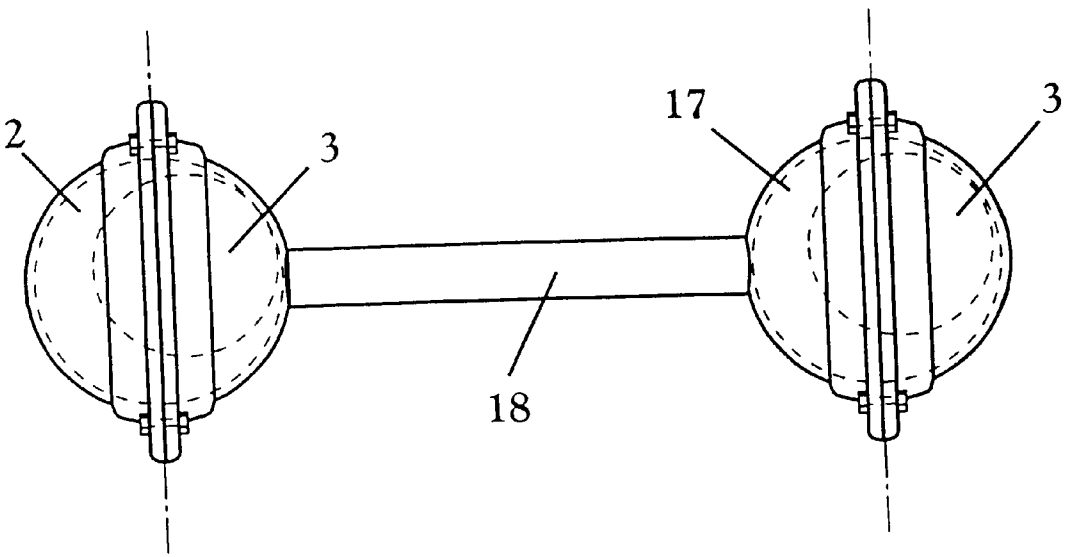
FIG. 6 is a front cross-sectional view of the exerciser of FIG. 5.
Figure 5:
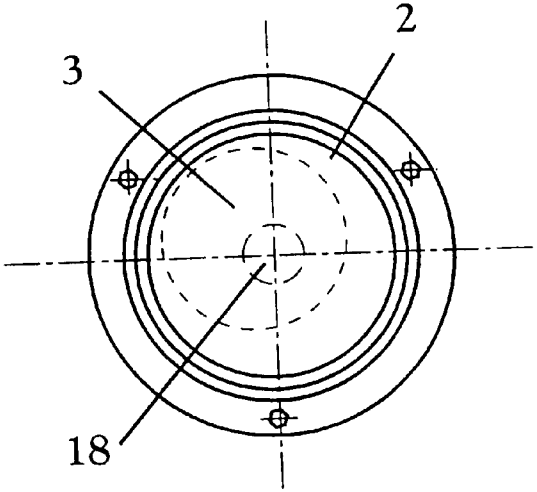
FIG. 5 is a side cross-sectional view of an exerciser provided with a central gripping bar and two lateral spherical casings connected thereto.

FIGS. 5 and 6 are show a variation of the device shown in FIGS. 1–4 and is an example of the inertial exercise device of the invention used as a barbell or dumbbell type exerciser. Therein, two of the spherical type inertial devices 1 are attached at either end of a bar or handle 18. The bar or handle 18 is attached to the casing 2 in a manner substantially similar to the attachment of the handle 16 as shown in FIGS. 3 and 4. The opposite end of the handle or bar 18 is attached to the other inertial exercise device 17 in a substantially similar manner as that of the attachment to casing 2 of the first exercise device. The external casings 2 and 17 of the exerciser devices are connected by a central bar or handle 18. Depending on the length of the central bar or handle 18, a user of the device may use two of the devices shown in FIGS. 5 and 6 by using one in each hand, or, in the alternative, a single device may be grasped with both hands of the user grasping the bar or handle 18. As in the first variant of the invention, motion is imparted to the spherical weights contained in the hollow spherical casings by the user. The user exercises by setting the spherical weights in motion and then works against the inertial of the moving weights so as to control movements of the weights and thereby exercise muscle groups during a workout.

Figure 7:
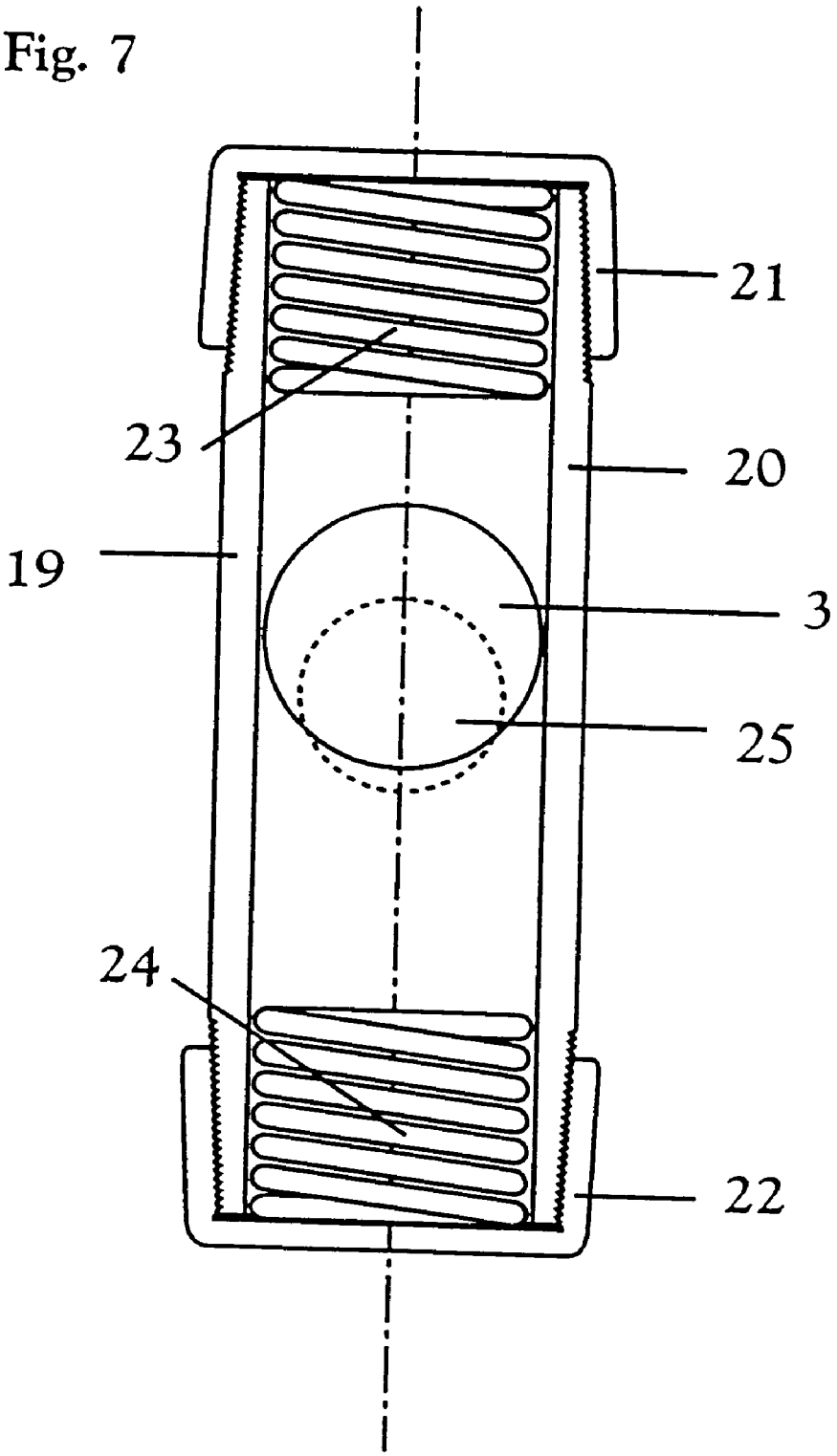
FIG. 7 is a top cross-sectional view of a hand-held exerciser having a tubular casing, a movable spherical shaped weight and lateral coil springs.
Figure 8:
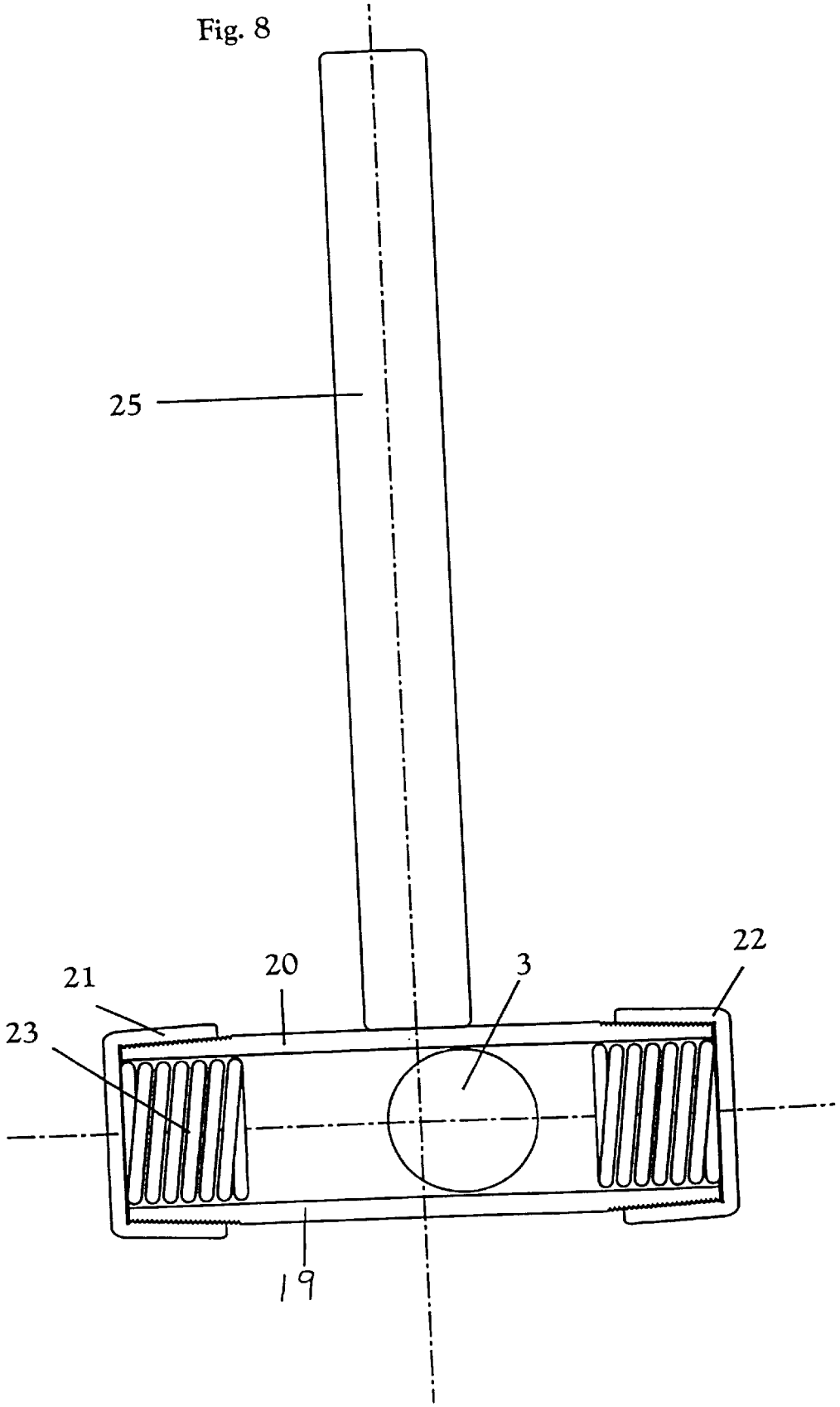
FIG. 8 is a front cross-sectional view of the exerciser described in FIG. 7.

FIGS. 7 and 8 are related views of another variant of the inertial exerciser of the present invention. In this variation, an exerciser 19 is provided with a cylindrical external casing 20. The casing 20 has end blockers or caps 21 and 22 located at opposite ends of the casing 20. The end blockers or caps 21 and 22 enclose the cylindrical external casing 20 so as to provide an enclosed chamber for the inertial exerciser. Coil springs 23 and 24 are located at opposite ends of the chamber as defined by the casing 20 and end blockers 21, 22. A spherical shaped weight 3 is positioned within the casing and located between the coil springs 23, 24. The casing 20 is provided with a handle 25. As in the foregoing variations. A user of the device grasps the handle 25 so as to impart motion to the exerciser 19. The motion thus imparted causes the spherical weight to roll or slide within the casing 20. The weight contacts the end springs which cushion the motion of the weight and also impart a force to the weight by release of spring energy stored by the compression of the springs. Of course, the springs 23 and 24 are compressed by the contact and compressive effects caused by the spherical weight 3. Due to the compression of the springs 23 and 24, the potential energy caused by the compression is released and the kinetic energy of the expansion of the springs 23, 24 also imparts a force to the weight 3 to urge the weight in the opposite direction of movement within the casing 20. The handle 25 is shown as attached to the casing 20 at approximately a central region of the casing 20. Other regions of attachment are also possible with the handle 25 being offset from a central region of the casing 20 and includes the possibility of the handle being attached to the caps 21 or 22. The handle 25 could be replaced by the strap and buckle arrangement 5, 6 shown in FIG. 1.

Figure 9:
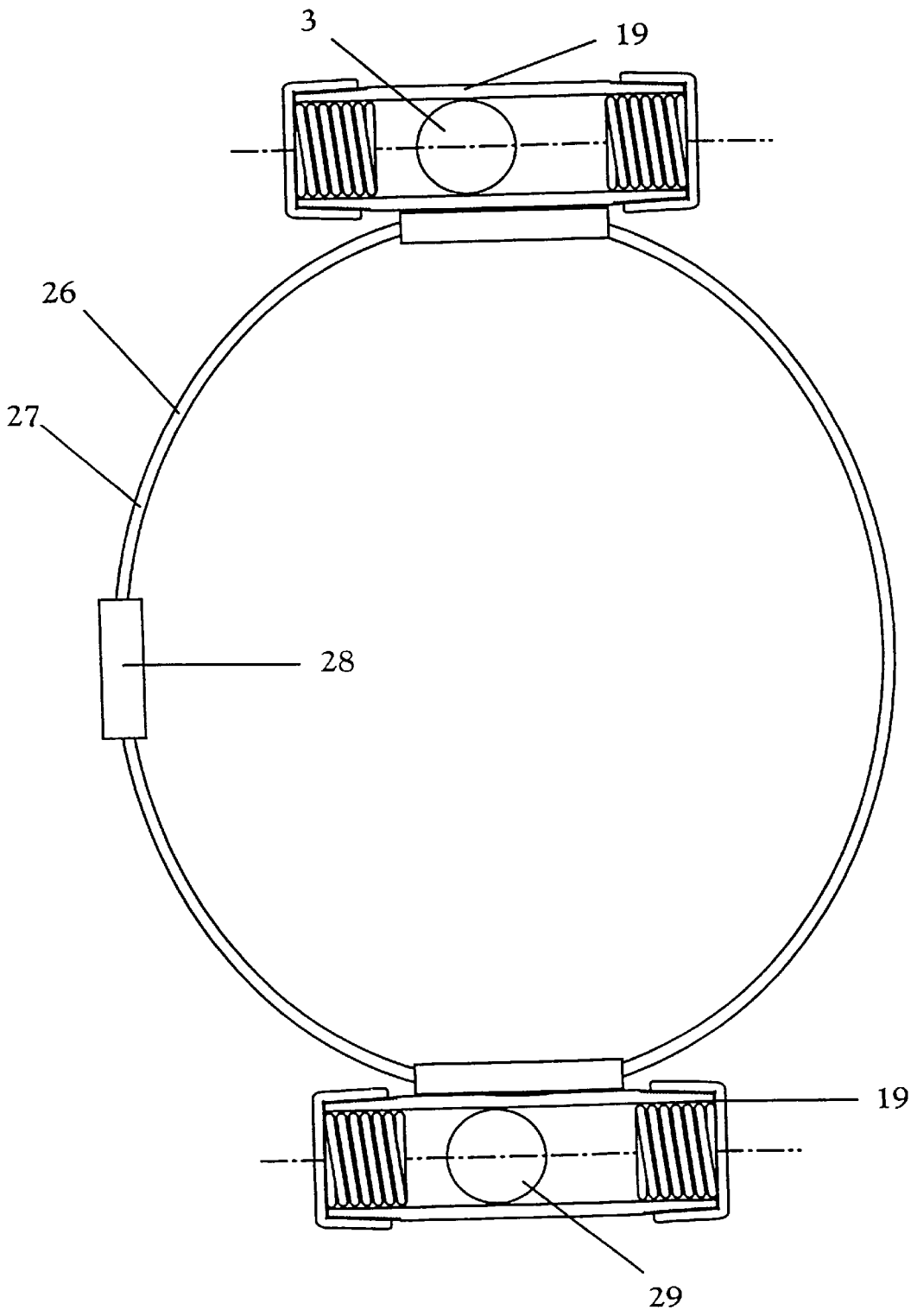
FIG. 9 is a top cross-sectional view of an exerciser having a belt positioned preferably by the hips of the user, and provided with two lateral, substantially tubular casings having two coil springs positioned by internal ends, and a spherical shaped weight, capable of reciprocating therewith.

FIG. 9 is a top cross-sectional view of an exerciser 26 which incorporates some of the features of the exerciser shown in FIGS. 7 and 8. Therein, two inertial exercise devices 19, as shown in FIGS. 7 and 8 are provided without the handle 25. Specifically, each exercise device 19 has a cylindrical external casing 20 with end blockers or caps 21, 22. A pair of coil springs 23, 24 are positioned at internal end regions of the device 19. A substantially spherical shaped weight 3, 29 is located in each of the exercise devices 19. In operation, the weights and springs function in substantially the same manner as the variation of FIGS. 7 and 8. However, in FIG. 9 two exercise devices 19 are provided and each has an attachment portion on a side of the spherical external casing 20 so as to provide an exerciser 26. The exerciser 26 includes a belt 27 and a buckle 28. The belt 27 is attached to the inertial exercisers 19 at the attachment portion provided on the side of the casing 20. In this variation, the belt and attached exercisers are strapped to the body of a user, preferably in the hip or abdomen region of the user's. Worn in this manner, the exerciser 26 has motion imparted thereto by movement of the users body so as to reciprocate the weights 3 and 29 in the same or opposite directions. For example, when a user attaches the exerciser 26 to his/her abdomen, a swivel movement of the user will result in the weights 3 and 29 reciprocating within the casing 20 in opposite directions of movement. A rocking or back-and-forth movement of the user would result in the weights 3 and 29 reciprocating in the same direction within the casings 20. The user exercises by imparting movement to the weights 3 and 29 in the same or opposite directions and then controlling movement of the weights by changing directions or movement of the weights 3 and 29 and/or controlling the speed of movement of the weights as they roll or slide within the casing 20.

Figure 11:
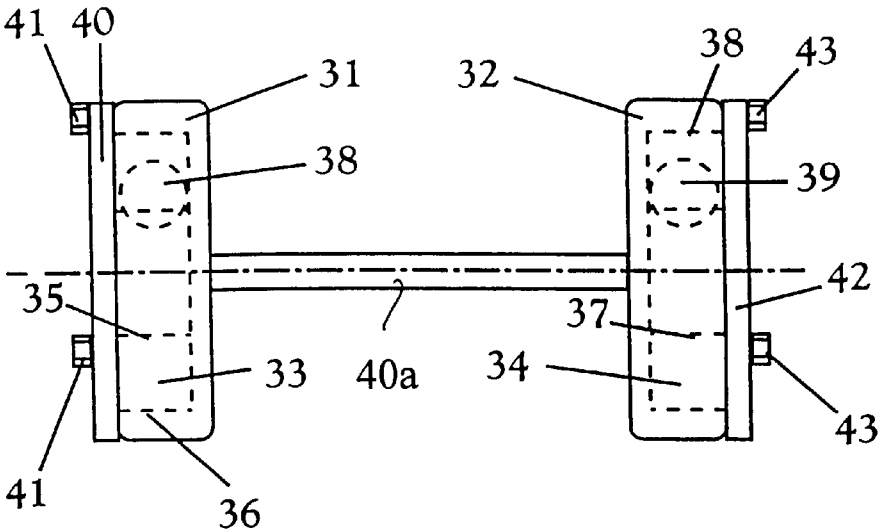
FIG. 11 is a front section of the hand-held exerciser of FIG. 10.
Figure 10:
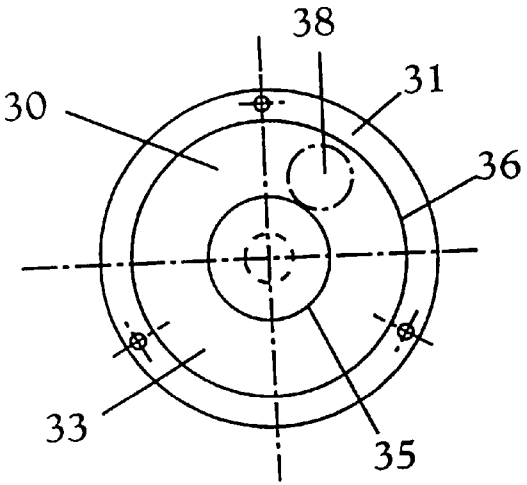
FIG. 10 is a lateral cross-sectional view of a hand-held exerciser, provided with a central rod with two lateral casings each having a substantial cylindrical recess for receiving a weight.

FIGS. 10 and 11 are side and front cross-sectional views of an exerciser 30, respectively. FIG. 11 shows an inertial exercise device 30 provided with lateral, spaced apart casing 31 and 32. Each of the casings 31 and 32 is provided with recesses 33 and 34. In the casing 31, first and second cylindrical walls 35 and 36 are provided, respectively. The casings 32 is provided with first and second cylindrical walls 37 and 38, respectively. A recess 33 is defined between the first and second cylindrical walls 35, 36 of the first casing 31. A recess 34 is defined between the first and second cylindrical wall 37, 38 of the casing 32. In each of the recesses 33 and 34, substantially spherical shaped weights 38 and 39 are provided so as to circulate within the recess by rolling and/or sliding. To contain the weights 38,39 within the casings 31,32, each casing is provided with a cover 40,42. The covers are in the shape of a flat wall and are secured to the casings by securing elements 41 and 43. The securing elements 41, 43 may be in the form of screws, bolts or any other suitable securing element which can maintain the flat wall elements in a secured relationship to the casings 31, 32. The securing elements 41,43 should permit removal of the flat wall elements 40 and 42 so as to provide a user with access to the interior of the casings. A bar or handle 40*a* connects the casings 31 and 32. As shown, the bar or handle 40*a* is located at a substantially central region of each of the casings 31,32. Depending upon the length of the bar or handle 40*a*, the user of the exercise device 30 can grasp the device so as to use at a single device with both hands or use two such devices, one in each hand. By lifting and imparting at a motion to the exerciser 30, the weights 38, 39 are set in motion. By continuous movement in the same direction, the weights roll or slide within the recesses 33 and 34. In order to keep the weights moving, the user must continue applying movement to the exerciser 30. In order to control movement of the weights 38,39, the user must exert force to stop the rolling/sliding motion of the weights This controlled movement may be in the form of stopping movement of the weights and/or reversing movement of the weights.

Figure 14:
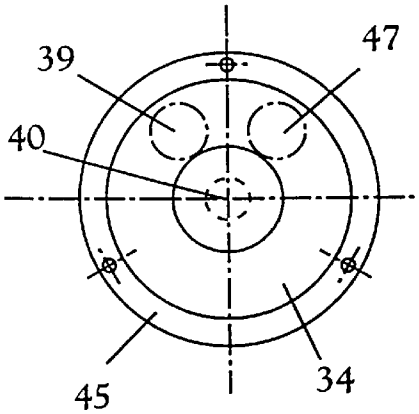
FIG. 14 is a right cross-sectional view of the exerciser provided with two spherical shaped weights as illustrated in FIGS. 12 and 13.
Figure 13:
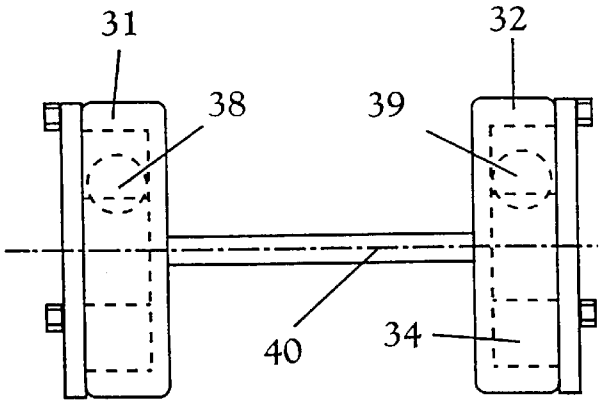
FIG. 13 is a front cross-sectional view of the exerciser of FIG. 12.
Figure 12:
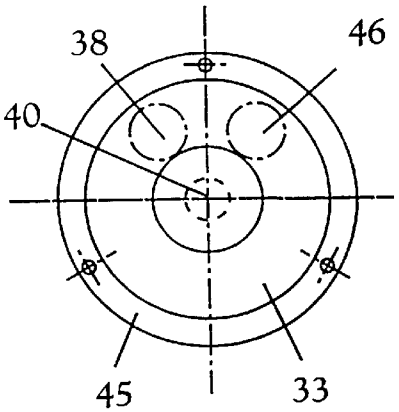
FIG. 12 is a left lateral cross-sectional view of an exerciser similar to that of FIGS. 10 and 11, provided with two equal spherical shaped weights.
Figure 16:
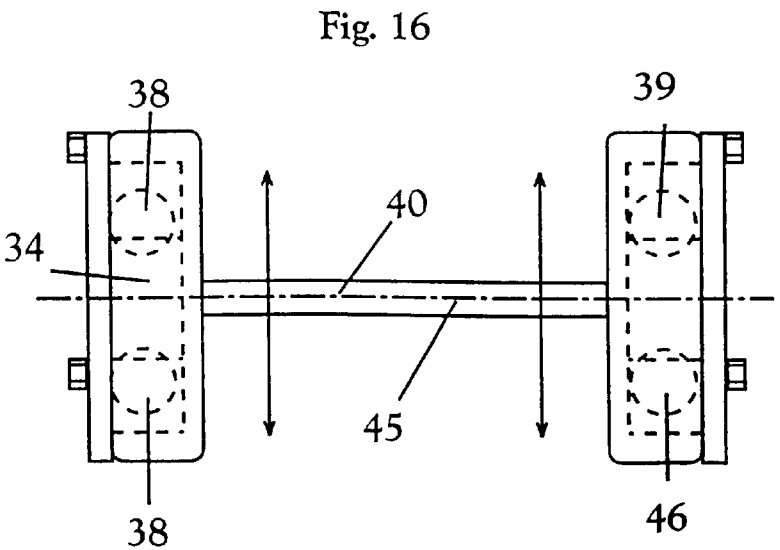
FIG. 16 is a front cross-sectional view of the exerciser of FIGS. 12–15 provided with arrows to indicate the linear reciprocating motion imparted to the exerciser in order to produce circular reciprocating motion of two equal, spherical weights.
Figure 15:
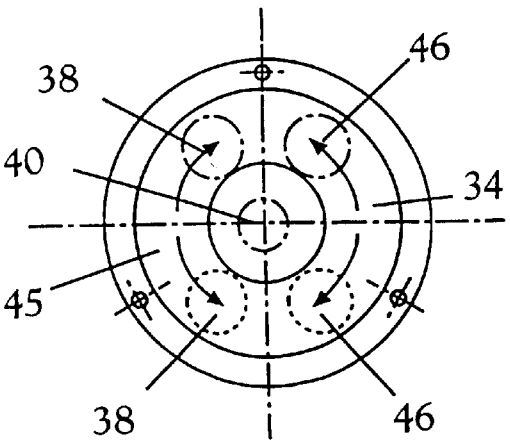
FIG. 15 is a lateral cross-sectional view of the exerciser of FIGS. 12–14 provided with arrows illustrating the circular reciprocating motion of the spherical weights.

FIGS. 12, 13 and 14 show an inertial exercise device 45 which is similar in structure to the exerciser 30. Accordingly, like parts will not be described in detail as reference may be made to the exerciser 30. In this variant, a plurality of weights are provided in each casing 31, 32. Thus, casing 31 is provided with substantially similar spherical weights 38 and 46. Casing 32 is provided with substantially similar spherical weights 39 and 47. The pairs of substantially similar spherical weights 39,46 of the casing 31 and the pairs of substantially similar weights 39, 47 of casing 32 can roll and/or slide in their respective recesses 33 and 34. The user of the exerciser 45 can put the weights into at a circular motion by imparting an orbital, substantially elliptical motion to the exerciser 45. Alternatively, when the user imparts a substantially vertical, linear reciprocating motion to the exerciser 45, the two pairs of spherical weights 38, 46 and 39, 47, respectively, move in at a circular reciprocation motion in different directions. When the exerciser is moved downward, the weights 38,46 move toward the top of the recess 33 and the weights 39,47 move toward the top of recess 34. At this top part of the recesses 33, 34, the weights collide and change direction of their circular movement. When the exerciser 45 is pushed upwards, the spherical pairs of weights move toward a bottom region of the recesses 33,34 and, in at a similar manner, collide with each other. This collision again changes direction of movement of the weights. This circular reciprocating motion of each pair of the weights can be maintained by continuously applying a substantially vertical, linear reciprocating motion. With reference to FIGS. 15 and 16, the movement of the weights is shown in more detail. Therein, the weights 38,46 of casing 31 are shown. a similar showing of the weights 39, 47 is unnecessary as the same type of movement will be imparted thereto. In FIG. 15, two positions of the weights 38 and 46 are shown. FIG. 16 shows an arrow indicating a substantially vertical reciprocating direction of movement of the exerciser 45. Movement of the exerciser 45 in the manner shown in FIG. 16 imparts at a movement to the weights 38 and 46 as shown in FIG. 15. Due to gravitational force, when the exerciser is pushed or pulled in the upward vertical direction, the weights 38, 46 move toward the bottom of recess 33. Peripheral edges of the weights collide at approximately the bottom center of the casing 31. The collision of the weights cause the weights to change direction of movement within the recess 33. When the exerciser 45 is moved in at a downward vertical direction, the weights 38, 46 move toward the top of the recess 33. Here again, the weight collide and start to move in opposite directions along the recess 33. Thus, the user imparts a vertical motion to the exerciser 45 and then must continually work against the movement of the weights while continuing to impart the substantially vertical reciprocating motion.

Figure 17:
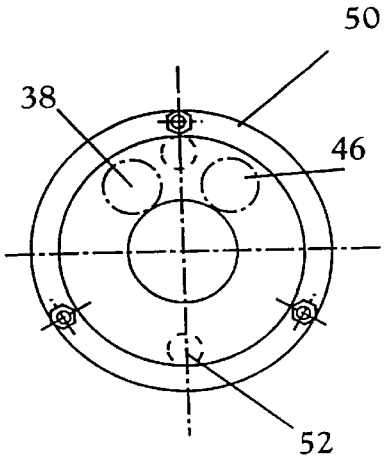
FIG. 17 is a lateral cross-sectional view in which lateral casings of the exerciser are connected by at least two holding handles.
Figure 18:
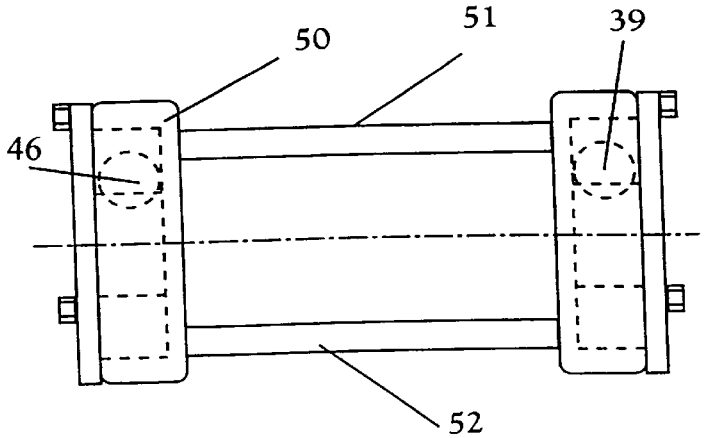
FIG. 18 is a side view of the device of FIG. 17.

FIGS. 17 and 18 show another form of the exerciser of FIGS. 12–14. The exerciser 50 shown in FIGS. 17 and 18 is similar to the exerciser 45. This variation uses two bars or handles 51 and 52 instead of the centrally positioned bar or handle 40*a*. This arrangement of the bars 51 and 52 permits a different exercise scenario. First, each of the bars 51 and 52 is offset from the center region of the casings containing the weights. As shown in FIG. 17 the bars 51, 52 are located on a central plane of the casing but displaced from the center region to adjacent at a peripheral edge portion of the casing. This structural arrangement permits two users to operate the exercise device 50 with each user gripping one of the bars 51, 52 with one or both hands. In this manner two or more users can impart an orbital substantially elliptical motion or a vertical linear reciprocating motion to the exerciser 50, so as to produce at a circular motion or a circular reciprocating motion, respectively, to the spherical shaped weights 38, 46 and 39, 47 shown in FIG. 15.

Figure 19:
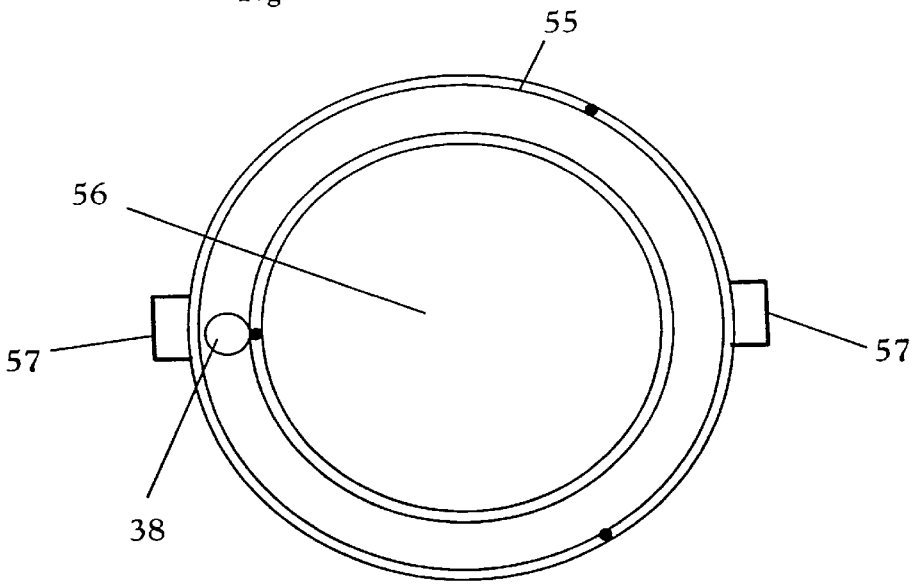
FIG. 19 is a top cross-sectional view of a hoop-like exerciser which is provided with a central cylindrical aperture and lateral, diametrically opposed handles.
Figure 20:
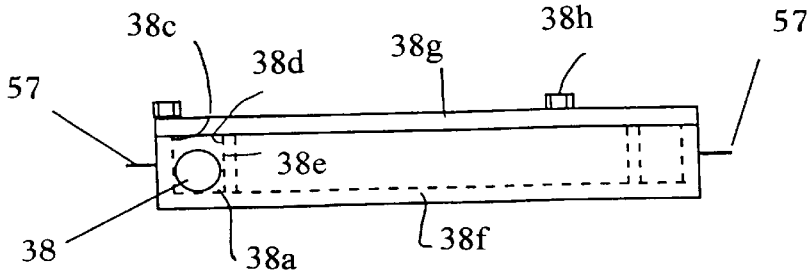
FIG. 20 is a frontal view of the hoop-like exerciser illustrated in FIG. 19.

FIG. 19 is at a top cross-sectional view of an exerciser 55 and FIG. 20 is at a side sectional view thereof. The exerciser 55 has at a circular concentric recessed section 56 and at a pair of external handles 57, shown on diametrically opposite sides of the exerciser. The exerciser 55 may be provided with a single spherical weight or a plurality of spherical weights, one of which is shown at 38. As shown, the exerciser 55 is somewhat similar to the exerciser 30, discussed above. A recess 38*a* is provided for the rolling/sliding movement of the spherical weight 38. The recess 38*a* is formed by an inner surface of an outer wall member 38*c* and an outer surface 38*d* of and inner wall member 38*e*. The wall members may be integral with at a bottom portion of casing 38*f*. The recess 38*a* is enclosed by at a top, substantially circular wall member 38*g* which may be secured to the bottom casing portion 38*f* by any appropriate securing element such as screws, bolts, etc., shown at 38*h*. In this variation, the exerciser may be held or positioned about the waist region of at a user. By grasping the handles to position the exerciser, the user can securely hold the exerciser in position while imparting motion to the weight and then controlling movement of the weights. Of course, many positions are available for using this exerciser. For example, the user may hold the exerciser above his/her head with both arms raised. In this position, the user can impart an orbital substantially elliptical motion or an approximately linear reciprocating motion in a substantially horizontal plane.

Figure 21:
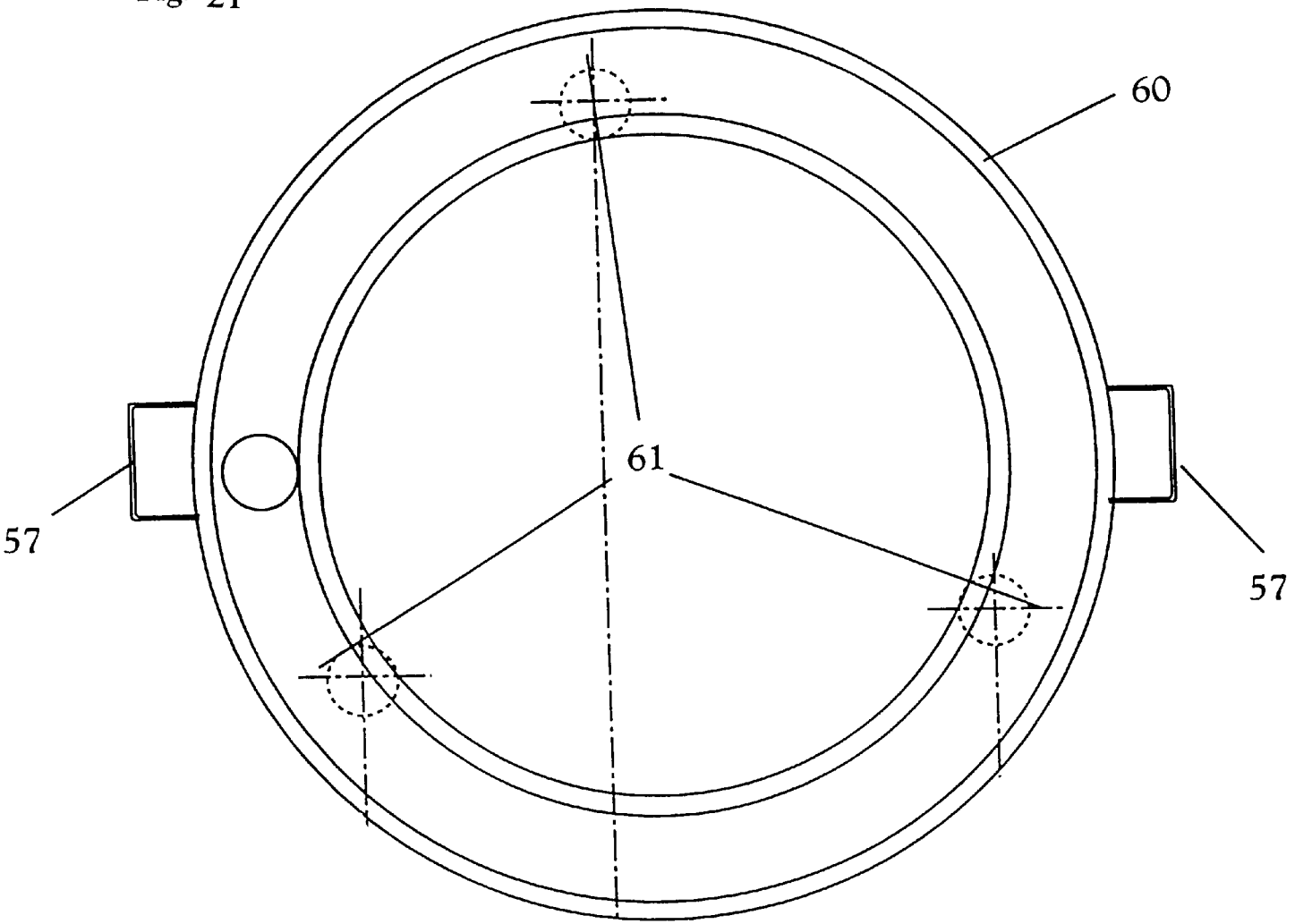
FIG. 21 is a top view of another variation of the inertia exerciser provided with a plurality of handles and eccentric wheels.
Figure 22:
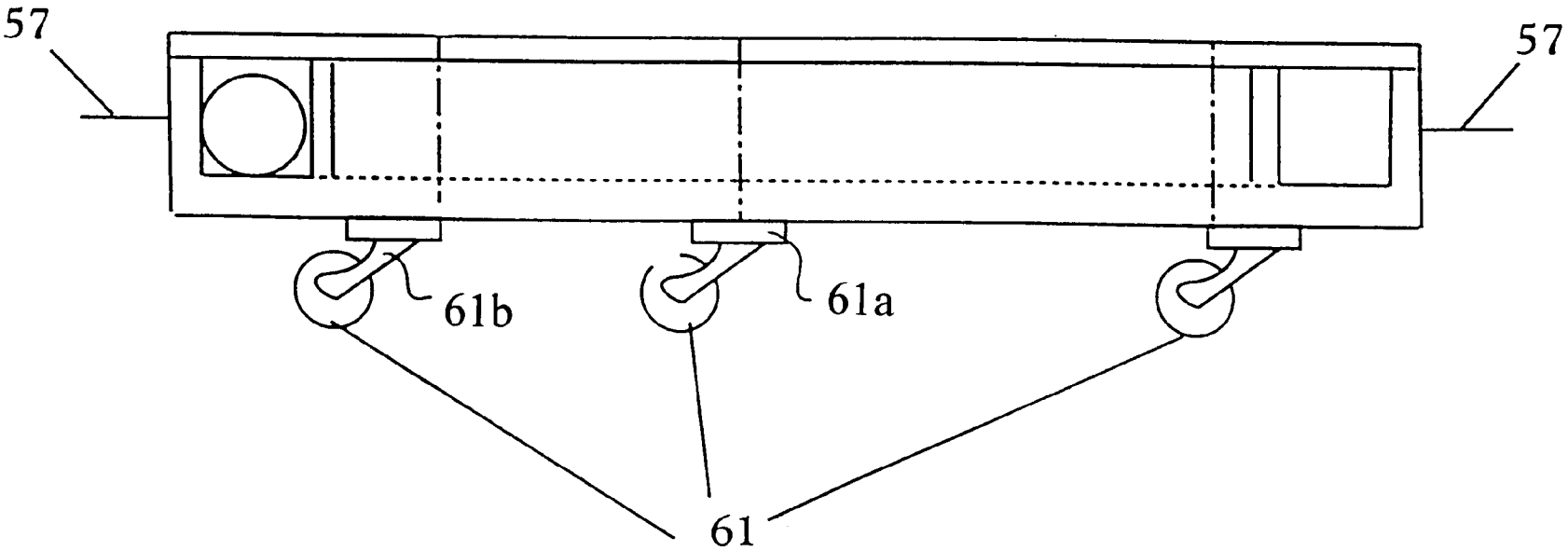
FIG. 22 is a is a front cross-sectional view of the exerciser shown in FIG. 21.

FIGS. 21 and 22 show another variant of the inertial exerciser of the invention. Therein, an exerciser 60 is shown which is similar to the exerciser 55 of FIGS. 19 and 20. a difference between exerciser 55 and exerciser 60 is that exerciser 60 is provided with wheels. In the arrangement shown, three wheels are provided at the bottom of casing 31. Each wheel 61 is spaced approximately 120 degrees from each other wheel at approximately equiangular locations. This spacing provides for appropriate balancing of the exerciser 60. Of course, fewer or more wheels may be used, depending upon the type of use a user of the device requires. The wheels or casters 61 are eccentric to the mounting part of the wheel. As shown, at a mounting part 61*a* is secured to the casing 31. The wheels 61 are offset from the mounting element 61*a* by an extension 61*b*. The extension 61*b* can rotate in the mounting 61*a* and the wheels can roll within the extension 61*b*. One or more spherical shaped weights are provided within at a recess as in FIGS. 19 and 20. A user of the exerciser 60 places the exerciser on a floor or table top or any other appropriately smooth horizontal surface. Again, movement is imparted to the weights by the user in the same manner as described in FIGS. 19 and 20; however, the exerciser 60 also permits the user to move or roll the exerciser on a flat surface in one direction while at the same time imparting a force to the weights in another direction. For example, the user could roll the device in at a linear direction while imparting a circular motion to the exerciser so as to cause the weight or weights therein to roll/slide within the recess.

Figure 23:
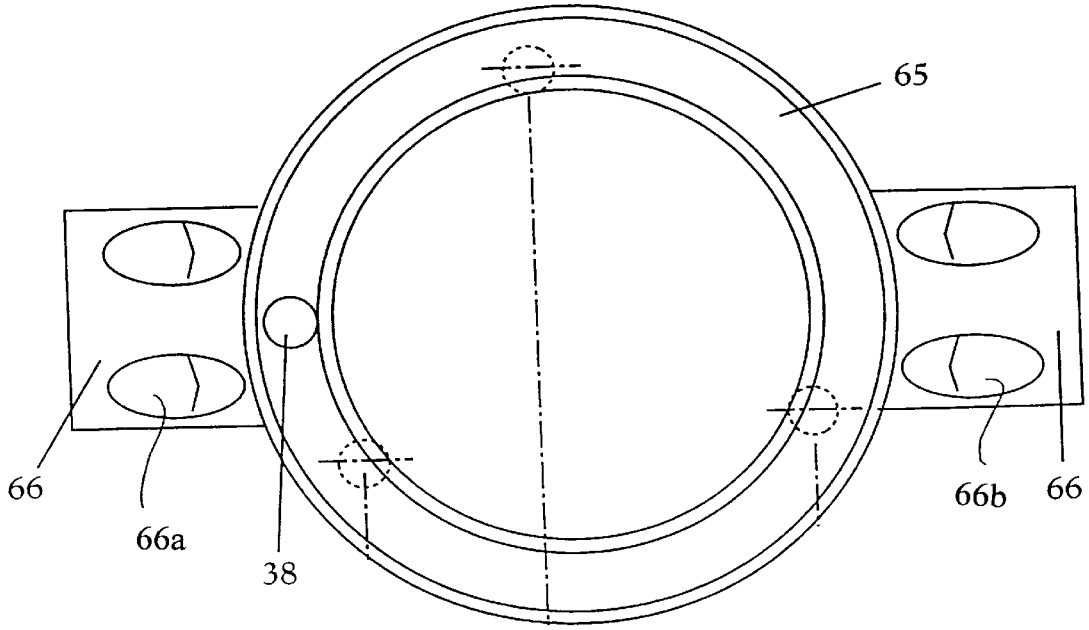
FIG. 23 is a top cross-sectional view of a variation of the exerciser provided with eccentric wheels, and further provided with a foot attachment.
Figure 24:
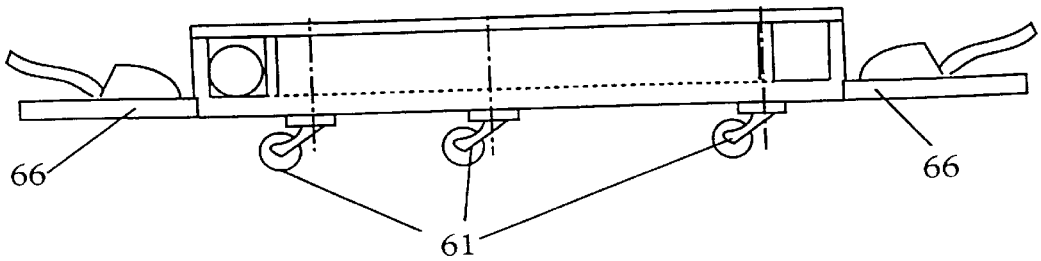
FIG. 24 is a front cross-sectional view of the exerciser shown in FIG. 23.

FIGS. 23 and 24 show an exerciser 65 which is similar to the exerciser 60 of FIGS. 21 and 22. The main difference residing in the provision of control plates 66 secured, as shown in the FIGS., at diametrically opposed sides of the exerciser. FIG. 23 shows the exerciser 65 in at a top, partial cross-sectional view with a pair of foot pads or foot rests 66*a* and 66*b* provided on each of the control panels 66. A user or users of the exerciser 65 could be seated with the exerciser 65 placed on at a substantially flat surface. The user/users insert his/their feet in the foot pads or rests 66*a*, 66*b* and impart motion to the exerciser 65. As the exerciser 65 is provided with the wheel arrangement of FIGS. 21 and 22, similar movements can be imparted to the exerciser. However, all of the movements are imparted by use of leg and foot muscles. The movement may be an orbital, substantially elliptical movement or linear reciprocating movement. The exerciser 65 may also be provided with one or at a plurality of spherical weights.

Figure 25:
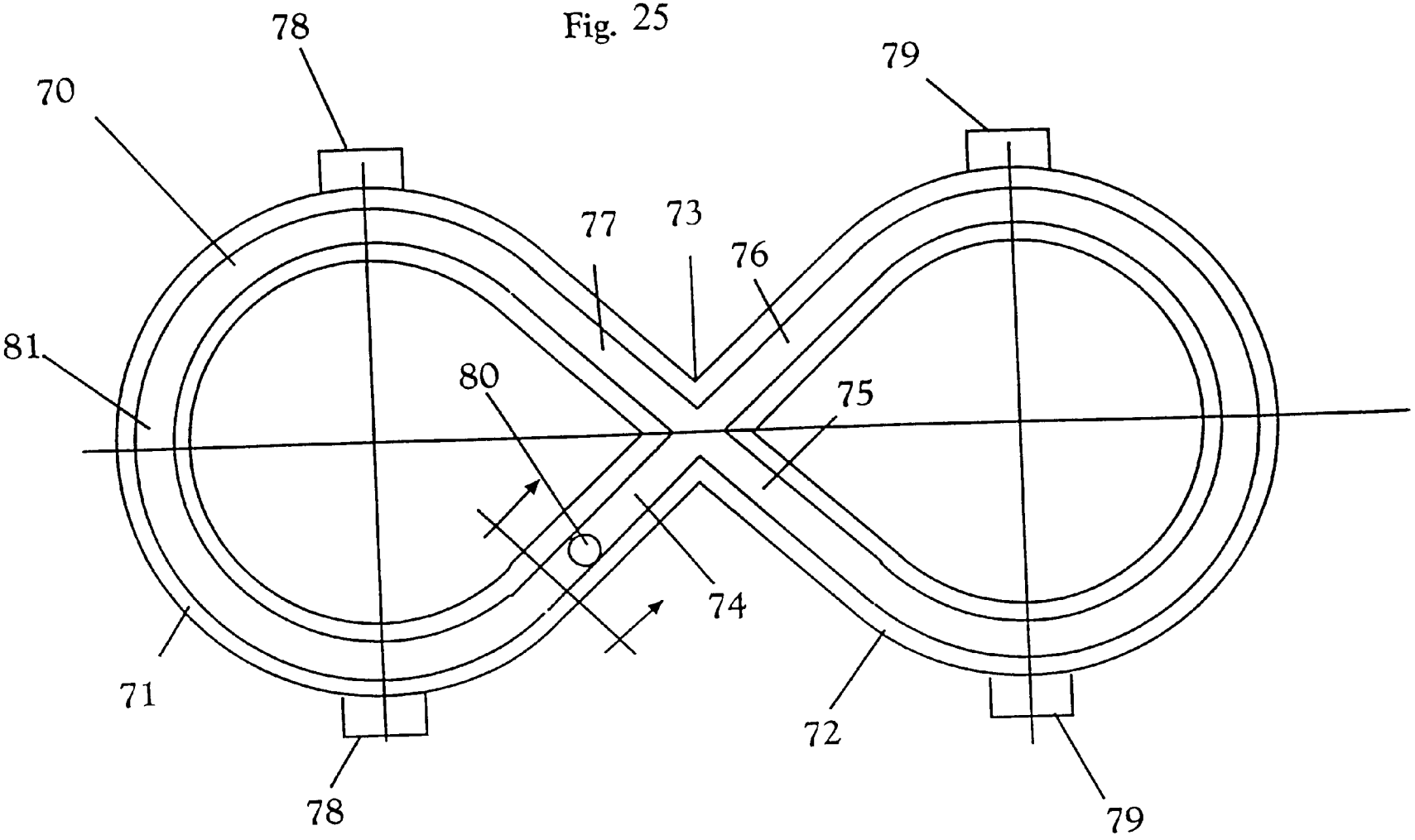
FIG. 25 is a top cross-sectional view of a variation of the exerciser having two connected hook-like members, provided with a partially curved and partially straight, uninterrupted recess, where a spherical shaped weight can circulate; and, FIG. 26 is a cross-sectional view of a substantially rectilinear section of the exerciser as indicated by the arrows of FIG. 25.
Figure 26:
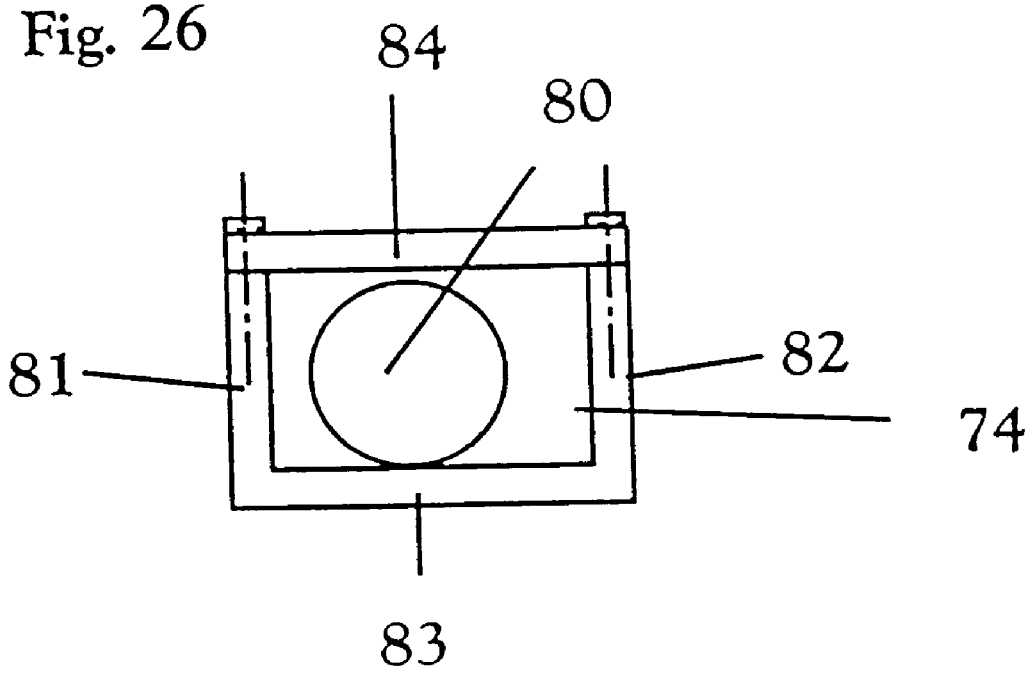

FIGS. 25 and 26 are top cross-sectional and side partial cross-sectional views of an inertial exerciser 70. Operation of the exerciser 70 is intended for two or more people. The exerciser 70 is of at a substantially figure eight shape. The exerciser is in the form of two symmetrical and opposed loops 71 and 72. The loops are connected at a cross-like center portion 73 which is provided with substantially straight sections 74, 75, 76, and 77. The substantially straight sections are integral with the loop portions. Generally, the exerciser 70 is of at a construction similar to the circular exerciser 55 of FIG. 19. That is, a bottom casing portion 83 is provided with substantially parallel side walls 81 and 82 so as to define a recess 74 therein. A top cover plate 84 covers the casing member 83 and is connected to the parallel side walls 81, 82 so as to provide a closed recess 74 in which one or at a plurality of substantially spherically shaped weights 80 can roll and/or slide. The exerciser 70 includes pairs of handles 78 and 79. A pair of users of the exerciser 70 would each grasp a set of handles 78,79. The users must coordinate their movements so as to impart to the exerciser an orbital, substantially elliptical motion so as to impart and maintain the spherical shaped weight(s) rolling/sliding movement on the figure-eight shaped internal recess 81. Of course, the users must impart and maintain the movement and coordinate their efforts to change movement direction of the weight. The degree of difficulty of controlling movement of the weight may be increased or decreased depending upon how the users are positioned with respect to one another and where they hold the exerciser. For example, the users may face one another to more easily coordinate their efforts and work on the same muscle groups. Alternatively, the users may face the same direction to increase the difficulty for one of the users who must hold the exerciser behind his/her back. This also has the effect of working a different muscle group from that of the other user. Additionally, the difficulty can be increased by holding the exerciser at different height levels and/or angles.

In all variants of the invention, the spherical shaped weights may be made of at a suitable plastic material or iron or steel. The casings of the variations may be made of transparent plastic material or any other suitable material. When any lighter weight material is used for the casings, structural metal reinforcements may be used. Such reinforcement material may be applied either integrally or separately to the casing material.

It is noted that the foregoing disclosure has been provided merely for the purpose of explanation and is in no way to be construed as limiting of the present invention. While the present invention has been described with reference to at a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An inertial exerciser, comprising:

a first semi-spherical housing member;

a second semi-spherical housing member connected to the first housing member so as to define a sphere, said sphere being hollow with a spherical recess between the first housing member and the second housing member;

at least one spherical weight member located in said recess and being movable therein;

a first arcuate inner section connected to an exterior wall of the first housing member;

a second arcuate inner section connected to an exterior wall of the second housing member;

a first flat ring secured to said first arcuate inner section;

a second flat ring secured to said second arcuate inner section;

at least one securing element connecting the first flat ring and the second flat ring so that the first housing member, the second housing member, the first arcuate inner section, the second arcuate inner section, the first flat ring and the second flat ring are maintained in a fixed positional relationship; and a holding element having one end connected to one of the first flat ring and the second flat ring on one side of thereof and an opposite end connected to an opposite side of said ring so that a user of the exerciser can impart and control movement of the exerciser.

2. The exerciser of claim 1, wherein said holding element is a flexible strap.

3. The inertial exerciser according to claim 1, wherein said at least one weight member is a plurality of weight members.

* * * * *